United States Patent [19]

Hicks et al.

[11] 4,341,390

[45] Jul. 27, 1982

[54] PATTERN LOCATION BOARD GAME DEVICE

[75] Inventors: Alan A. Hicks, Chicago; Jeffrey D. Breslow, Highland Park, both of Ill.

[73] Assignee: Marvin Glass & Associates, Chicago, Ill.

[21] Appl. No.: 197,919

[22] Filed: Oct. 17, 1980

[51] Int. Cl.[3] ..... A63F 3/00

[52] U.S. Cl. ..... 273/265; 273/288

[58] Field of Search ..... 273/265, 273, 288

[56] References Cited

U.S. PATENT DOCUMENTS 4,059,274 11/1977 Samson et al. ..... 273/265

FOREIGN PATENT DOCUMENTS 4612 of 1911 United Kingdom ..... 273/269

*Primary Examiner*—Anton O. Oechsle

*Attorney, Agent, or Firm*—Mason, Kolehmainen, Rathburn & Wyss

[57] ABSTRACT

A pattern location board game device is described in which each player attempts to locate a pattern of playing positions selected by an opponent. The device includes a game board having a plurality of playing positions bearing indicia representative of each one of a plurality of articles of clothing and each one of a plurality of colors. A plurality of identical playing positions are dispersed on the game board. Each player has a playing position selection box that displays the various articles of clothing represented on the game board while concealing a set of colored pegs received in apertures in the box associated with each represented article of clothing. The colored pegs are selectively positioned in the apertures associated with the articles of clothing to indicate the selected pattern of playing positions on the game board. A plurality of clear, transparent discs are used to mark certain playing positions on the game board which one player believes represent the selected positions of another player.

10 Claims, 4 Drawing Figures

PATTERN LOCATION BOARD GAME DEVICE

BACKGROUND OF THE INVENTION

1. Field of the Invention

This invention relates generally to board game entertainment devices and particularly to concealed pattern determining board game devices.

2. Brief Description of the Prior Art

Game devices which involve the identification by one player of a pattern preselected by another player within a gridwork of playing positions by repeated guesses are known in the art. These games often take the form of simulated naval warfare wherein one player locates a plurality of battleships on a concealed grid pattern and the other player attempts to guess the location of the battleships by calling out random grid locations. The player who positioned the battleships then indicates whether the selected grid locations result in hits or misses of the concealed battleship. While such games are capable of considerable entertainment value, they unfortunately possess limited complexity and permit minimal strategizing.

SUMMARY OF THE INVENTION

It is an object of the present invention to provide a game device which is capable of considerable entertainment for its users.

It is another object of the present invention to provide a pattern location board game device making possible much strategizing.

It is also an object of the present invention to provide a board game pattern location device of increased complexity and challenge.

These and other objects of the present invention are provided by a board game device including a plurality of playing pieces and a game surface. The game surface bears a matrix of playing positions, each playing position bearing indicia representative of one variable of a first and one variable of a second set of variables. Each variable set includes a plurality of variables, each indicated by indicia on the surface and the game surface possesses a plurality of playing positions bearing substantially identical indicia. Means are included for indicating each of the first set of variables separately from the game surface and for indicating each of the second set of variables separately of the game surface. Means are provided as well for indicating a geometric pattern of indicia representative of the first set of variables on the game surface by associating the first set indicating means with the second set indicating means.

BRIEF DESCRIPTION OF THE DRAWING

These and other objects of the present invention will become more apparent with reference to the following description taken in conjunction with the accompanying drawing, wherein.

DESCRIPTION OF THE PREFERRED EMBODIMENT

Figure 1:
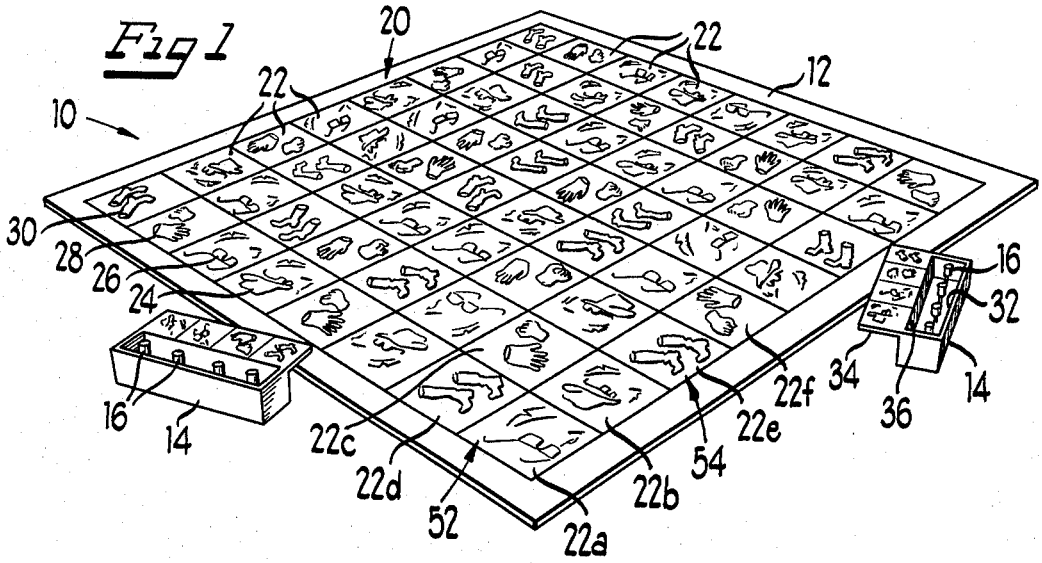
FIG. 1 is a perspective view of one embodiment of the present invention.

Referring to the drawing wherein like reference characters are used for like parts throughout, there is shown in FIG. 1 a board game device 10. The device 10 includes a game board 12, a pair of pattern selection boxes 14, a plurality of color selection pegs 16, and a plurality of transparent playing position selection discs 18. The game board 12 has a playing surface 20 having a plurality of rectangular playing positions 22 arranged in transverse rows and columns.

Each playing position 22 bears indicia representative of a first set of variables conveniently composed of articles of clothing including a hat 24, glasses 26, gloves 28 and boots 30. In addition each playing position 22 is colored in one of four randomly selected colors (not shown) making up a second set of variables. In the embodiment illustrated in FIG. 1, an eight by eight matrix of sixty-four playing positions in the transverse rows and columns bearing randomly distributed indicia are illustrated. With this arrangement, each playing position includes three identical playing positions located elsewhere on the board.

Figure 2:
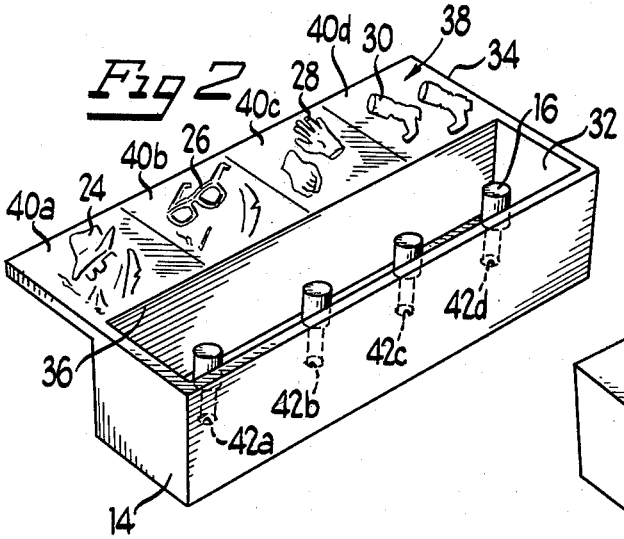
FIG. 2 is an enlarged perspective view of the pattern selecting box shown in FIG. 1.
Figure 3:
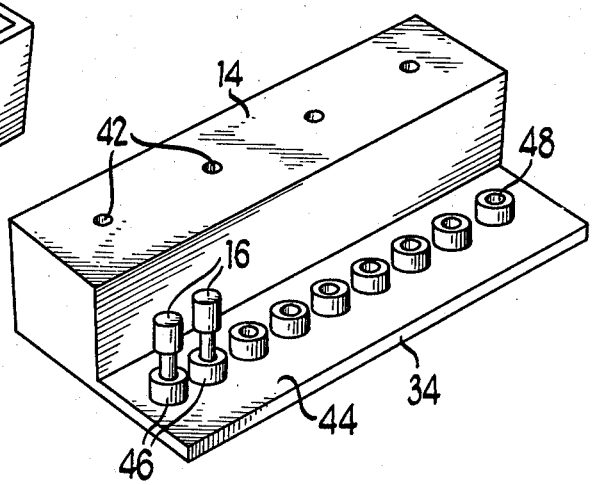
FIG. 3 is an enlarged perspective view of the bottom of the pattern selecting box shown in FIG. 1.

The pattern selection boxes 14 include an open rectangular container portion 32 and a horizontal surface 34 connected to the portion 32 along common edge 36. The upper surface 38 of the horizontal portion 34 is divided into regions 40 displaying the hat 24, glasses 26, gloves 28, and boots 30 indicia also contained on game board 12 as shown in FIG. 2. The bottom surface of container portion 32 includes four apertures 42 each aligned with one of the regions 40. The apertures 42 are sized to receive a color selection peg 16. Each color selection peg 16 is colored with one of the four colors used on game board 12. As shown in FIG. 3, the underside 44 of horizontal portion 34 includes a plurality of aligned, outwardly extending tubular portions 46 having central openings 48 sized, like apertures 42, to receive pegs 16.

Figure 4:
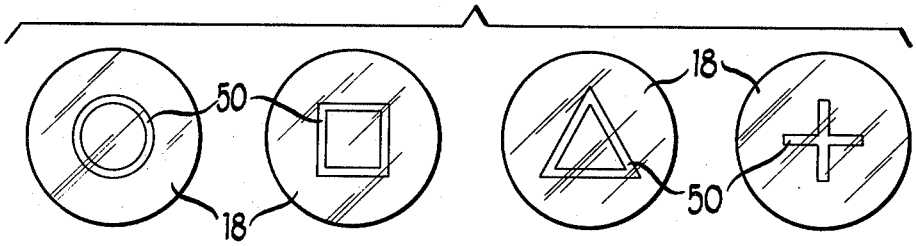
FIG. 4 shows an enlarged plan view of the discs used in conjunction with the embodiment of the invention shown in FIG. 1.

Transparent playing position selection discs 18, shown in FIG. 4, are sized to fit substantially within one playing position 22 on game board 12. The discs 18 bear indicia 50 such as circles, squares, triangles, or plus signs indicative of each player. When a disc 18 is positioned atop a playing position 22 the indicia on the game board 12 is still visible through the disc 18 since the discs 18 are transparent.

A preferred embodiment of the game board device 10 can be played as follows. Each of two or more players first locates a pattern of playing positions 22 bearing one hat 24, one glasses 26, one gloves 28 and one boots 30 indicia. The pattern must include four contiguous playing positions regardless of color, arranged either in a line or a square. A square pattern 52 is shown in FIG. 1, made up of playing positions **22*a*, 22*b*, 22*c* and 22*d*. A line pattern 54 is also shown in FIG. 1, made up of playing positions 22*a*, 22*b*, 22*e* and 22*f*. A large number of other square patterns 52 and line patterns 54 are contained on game board 12**.

The player preserves the selected pattern by positioning colored selection pegs 16 within apertures 42 in pattern selection boxes 14. This is accomplished by positioning a peg 16 bearing the color of the selected playing position 22 having a hat 24 indicia in aperture **42*a* aligned with hat indicating region 40*a*, positioning a peg 16 bearing the color of the playing position 22 having the glasses 26 indicia in aperture 42*b* aligned with glasses indicating region 40***b* and so on until the entire pattern is preserved by a pattern of color selection pegs 16 positioned in apertures 42. In this way the player selection is preserved within box 14 out of sight and concealed from the other player.

When this process has been completed, the first player randomly guesses a color for one of the playing position indicia 24 through 30 of another player. If the guess corresponds to the other player's preselected choice, the other player surrenders the corresponding peg 16. The player making the correct guess then positions the peg 16 in a central opening 48 on the underside 34 of his or her box 14. Next the player making the correct guess positions a transparent playing position selection disc 18 bearing indicia 50 representative of the other player atop one of the playing positions 22 bearing the corresponding indicia 24 through 30 and color which were correctly guessed. Since in the embodiment pictured, each playing position 22 has three identical playing positions at different locations on board 12 the player must either randomly or using an educated guess select one of the four playing positions 22 bearing identical indicia upon which to position the disc 18. The player making the correct guess continues to make guesses until an incorrect guess is made. Then another player tries to guess the position of one of the playing positions making up another player's preselected pattern of playing positions 22. If the guess is incorrect the player is so informed. If the guess is correct the guessing player receives the other player's peg 16 as described previously.

With the game board 12 shown in FIG. 1, each playing position 22 is part of several distinct patterns 52 or 54. Having guessed one correct combination of indicia 24 through 30 and its associated color, the player must choose one of the four positions 22 bearing that combination and then must attempt to use strategy to establish whether the selected position 22 is correct and to determine the makeup of the remaining preselected playing positions 22 of the concealed selected pattern 52 or 54.

When one player's preselected pattern is located by placing all his or her discs 18 on the correct pattern that player will also have given up all of his or her pegs 16 to other players. However, the player may continue to ask questions of the other players until the last player's pattern has been located. The winner is the player who has collected the most pegs 16 from the other players.

The initial positioning of the disc 18 is subject to re-evaluation by the positioning player as that player receives more information about the make-up of the unknown pattern. Thus, the players must use considerable ingenuity and effort to determine which of the identical playing positions is the one selected by the other player.

Using the clothing indicia 24 through 30 for the playing positions 22, the play may proceed as an attempt to identify a fictional "invisible man". When a player's pattern has been identified, that player's "invisible man" is then located.

Many variations are possible from the preferred embodiment set forth above. For example, the form of the indicia 24 through 30 used to identify the first set of variables and the use of colors associated with the playing positions 22 to identify the second set of variables is subject to much variation, although these variables can result in an enjoyable game in which players attempt to identify an "invisible man". The size of the game board 12 and the number of different patterns included thereon is subject to considerable variation and may be adapted to a desired player age group. Thus each playing position 22 may be a part of up to eight square and straight line patterns 52 and 54. The higher the number of possible patterns the greater the complexity of the game. In addition, diagonal patterns may be permitted to further increase the complexity of the game.

The foregoing detailed description has been given for clearness of understanding only and no unnecessary limitations should be understood therefrom. Many modifications and variations will be obvious to those skilled in the art. Thus it is to be understood that, within the scope of the appended claims, the invention may be practiced otherwise than as specifically described above.

What is claimed is:

1. A board game device comprising:

a plurality of playing pieces;

a game surface bearing a matrix of playing positions, each playing position bearing indicia representative of one variable of a first and one variable of a second set of variables, each variable set including a plurality of variables, each variable indicated by said indicia on said surface, said game surface including a plurality of playing positions bearing substantially identical indicia;

means for indicating each of said first set of variables separately of said game surface;

means for indicating each of said second set of variables separately of said game surface;

means for indicating a geometric pattern of indicia representative of said first set of variables on said game surface by associating said first set indicating means with said second set indicating means; and said means for indicating said first set of variables being colored pegs and said means for indicating a geometric pattern including an open container having a plurality of slots for receiving said pegs and having associated with each slot a region bearing indicia representative of said first set of said variables.

2. The device of claim 1 wherein said first set of variables are articles of clothing and said second set of variables are colors.

3. The device of claim 1 wherein said means for indicating said first set of variables located in a concealed location within said container, said container further including an outwardly directed flange, said means for indicating said second set of variables located in plain view on said outwardly extending flange.

4. The device of claim 3 wherein said outwardly extending flange includes said indicia on one side and includes means for retaining said pegs on the other side.

5. The game device of claim 1 wherein said playing pieces are transparent.

6. The game device of claim 1 wherein said matrix of said playing positions is made up of a plurality of transverse rows and columns.

7. The device of claim 1 wherein said playing positions are arranged in a plurality of patterns made up of a plurality of playing positions arranged contiguously with different indicia representative of said first set of variables included thereon.

8. The device of claim 7 wherein said patterns are in the form of rectangles and lines.

9. The game device of claim 1 wherein said first set of variables includes at least four variables and said second set of variables includes at least four variables. said game surface containing at least four playing positions bearing identical indicia representative of each combination of one variable of said first set with one variable of said second set.

10. A board game device comprising:

a plurality of playing pieces;

a game surface bearing matrix of playing positions, each playing position bearing indicia representative of one variable of a first and one variable of a second set of variables, each variable set including a plurality of variables, each variable indicated by said indicia on said playing surface, said game surface including a plurality of playing positions, bearing substantially identical indicia;

means for indicating each of said first set of variables separately of said game surface;

means for indicating each of said second set of variables separately of said game surface;

means for indicating a geometric pattern of indicia representative of said first set of said variables on said game surface by associating said first set indicating means with said second set indicating means; and said first set of variables including at least four variables and said second set of variables including at least four variables, said game surface containing at least four playing positions bearing identical indicia representative of each combination of one variable of said first set with one variable of said second set.

* * * * *